US005362216A

United States Patent [19]

Hammelmann

[11] Patent Number: 5,362,216

[45] Date of Patent: Nov. 8, 1994

[54] COAXIAL VALVE ARRANGEMENT FOR HIGH PRESSURE POSITIVE DISPLACEMENT PUMPS

[76] Inventor: Paul Hammelmann, Zum Sundern 17, D-4740 Oelde, Germany

[21] Appl. No.: 2,328

[22] Filed: Jan. 8, 1993

[30] Foreign Application Priority Data

Jan. 11, 1992 [DE] Germany ..... 4200536

[51] Int. Cl.[5] ..... F04B 21/02

[52] U.S. Cl. ..... 417/567; 417/571; 137/512.3

[58] Field of Search ..... 417/560, 567, 569, 570, 417/571; 137/512.3

[56] References Cited

U.S. PATENT DOCUMENTS

| | | | |
|---|---|---|---|
| 554,604 | 2/1896 | Morgan | 417/561 |
| 3,114,326 | 12/1963 | Yaindl | 417/567 |
| 3,702,624 | 11/1972 | Fries | 417/567 |
| 3,709,638 | 1/1973 | Iguchi et al. | 417/571 |
| 3,777,779 | 12/1973 | Schwaller | 137/512.3 |
| 4,174,194 | 11/1979 | Hammelmann | 417/567 |
| 4,412,792 | 11/1983 | LaBorde et al. | 417/571 |
| 4,616,983 | 10/1986 | Hanafi | 417/571 |
| 4,741,680 | 5/1988 | Bröker et al. | 417/567 |
| 4,878,815 | 11/1989 | Stachowiak | 137/512.3 |
| 5,037,276 | 8/1991 | Tremoulet, Jr. | 137/512.3 |
| 5,147,189 | 9/1992 | Barnowski | 417/567 |

*Primary Examiner*—Richard A. Bertsch
*Assistant Examiner*—Roland G. McAndrews, Jr.
*Attorney, Agent, or Firm*—Darby & Darby

[57] ABSTRACT

A positive displacement pump wherein the housing has a thin one-piece plate-like head bolted to the adjacent end of a casing for one or more reciprocable plungers. Each plunger is coaxial (a) with a suction intake valve installed in a larger-diameter portion of a two-part insert in the casing adjacent the head, and (b) with an outlet valve installed in a recess of the head adjacent a second portion of the insert. The second portion of the insert is surrounded by an annular space which communicates with a main suction chamber of the pump to return into the suction chamber any fluid leaking between the two portions of the insert. The second portion has a first seat disposed at one end of an axial channel and forming part of the intake valve, and a second seat disposed at the other axial end of the channel and forming part of the outlet valve. The second seat is disposed at or in the plane of abutment between the head and the casing of the pump housing, and the axial length of the reciprocable valving element of the outlet valve equals or is slightly less than the thickness of the one-piece head. The recess of the head serves to convey pressurized fluid to one or more consumers.

18 Claims, 3 Drawing Sheets

COAXIAL VALVE ARRANGEMENT FOR HIGH PRESSURE POSITIVE DISPLACEMENT PUMPS

BACKGROUND OF THE INVENTION

The invention relates to improvements in positive displacement pumps, also known as volumetric pumps, and more particularly to improvements in pumps which operate or can operate at pressures of up to and above 2000 bar. Still more particularly, the invention relates to improvements in positive displacement pumps of the type wherein a fluid-admitting intake valve is coaxial with a fluid discharging outlet valve and wherein the two valves are coaxial with the fluid displacement body if the latter is a reciprocable body, such as a plunger.

A positive displacement pump of the above outlined character is disclosed, for example, in U.S. Pat. No. 5,147,189 granted Sep. 15, 1992 to Barnowski. The head of the pump housing is assembled of two parts and its height (as considered in the direction of the common axis of the intake and outlet valves) is considerable. The two-piece head has an internal compartment for nearly complete confinement of a composite insert which abuts the cylinder for the reciprocable plunger of the positive displacement pump. The insert extends across the plane of abutment between the two parts of the head as well as across the plane of abutment between the head and the casing of the pump. This can create problems when the pump is to deliver a highly pressurized fluid because such fluid is likely to leak between the two parts of the head and/or between the head and the casing of the pump housing, especially if the plane of contact between the two portions of the insert is located forwardly of and/or at a level above the plane of contact between the two parts of the head. The intake and outlet valves of the just described conventional pump are installed in the head of the pump housing, and this also creates problems when the pump is operated at an elevated pressure. Thus, the useful life of the composite pump head is shortened because the head is continuously subjected to stresses which fluctuate within a very wide range, namely between those which develop when the displacement body of the pump performs suction strokes and those which develop when the displacement body performs pressure strokes. Moreover, the just described pump is rather bulky and the cost of making and assembling its constituents, including the composite head and the composite housing, is high.

OBJECTS OF THE INVENTION

An object of the invention is to provide a positive displacement pump wherein the head of the pump housing is not subjected to stresses which fluctuate within a wide range.

Another object of the invention is to provide a positive displacement pump, such as a plunger pump, wherein any fluid which happens to leak between the portions of the insert remains confined in the housing.

A further object of the invention is to provide the above outlined positive displacement pump with a novel and improved insert or carrier of intake and outlet valves.

An additional object of the invention is to provide a positive displacement pump wherein the intake valve is constructed, assembled and mounted in a novel way.

Still another object of the invention is to provide a positive displacement pump wherein the outlet valve is constructed, assembled and mounted in a novel way.

A further object of the invention is to provide a positive displacement pump with a novel and improved housing.

Another object of the invention is to provide the housing of the above outlined positive displacement pump, such as a plunger pump, with a novel and improved head.

An additional object of the invention is to provide the above outlined positive displacement pump with a novel and improved system of internal fluid conveying channels, bores, openings, ports and other passages.

Still another object of the invention is to provide the above outlined pump with a simple, inexpensive and compact housing.

A further object of the invention is to provide a positive displacement pump which constitutes an improvement over and a further development of pumps disclosed in U.S. Pat. No. 5,147,189.

Another object of the invention is to provide a novel and improved method of assembling the component parts of the above outlined positive displacement pump, particularly a plunger pump which is operated or which can be operated at pressures in the range of and above 2000 bar.

SUMMARY OF THE INVENTION

The invention is embodied in a positive displacement pump, particularly for operation at pressures above 2000 bar. The improved pump comprises a housing including a casing and a one-piece head which is affixed to the casing, an insert which is installed in the casing adjacent the head and includes a first portion and a second portion the second portion being disposed between the first portion and the head, a fluid-admitting suction intake valve including a first mobile valving element at the first portion of the insert and a first seat for the first valving element at the second portion of the insert, a fluid discharging outlet valve coaxial with the intake valve and including a second mobile valving element at the head and a second seat for the second valving element at the second portion of the insert, and a displacement body which is reciprocable in the casing to draw a fluid into a chamber of the housing through the intake valve and to expel fluid from the chamber through the outlet valve.

The pump further comprises a cylinder for the displacement body. The cylinder is disposed in the casing and abuts the first portion of the inlet. The displacement body (e.g., a plunger) is preferably coaxial with the two valves and the cylinder is at least partially surrounded by the chamber in the housing of the improved pump.

The head and the casing of the housing can be provided with at least substantially coplanar abutting surfaces, and the second seat can be located at least close to the common plane of such surfaces. This head can constitute a one-piece plate, and the second valving element can have a length, as measured in the direction of the common axis of the two valves, which approximates or is slightly less than the thickness of the head (as measured in the direction of the common axis of the valves).

The second portion of the insert can have an axially extending channel with a first end at the first seat and a second end at the second seat. The two seats are preferably concentric with each other and with the channel of the second portion of the insert. The first and second seats can be provided on first and second projections of the second portion of the insert. To this end, the first portion of the insert can be provided with a first recess for the first projection, and the head can be provided with a second recess for the second projection of the second portion of the insert.

The first valving element can constitute or include a plate, and the intake valve can further comprise means (e.g., one or more coil springs) for biasing the plate against the first seat. Such plate and the biasing means of the intake valve can be disposed in the aforementioned recess of the first portion of the insert. As mentioned above, the cylinder for the displacement body (such as a reciprocable plunger) can be disposed in the housing in such a way that it abuts the first portion of the insert.

The second portion of the insert can be provided with at least one suction port extending from the first seat to a space which at least partially surrounds the second portion of the insert in the casing. The suction port can be inclined with reference to the common axis of the two valves; such at least one suction port preferably extends from a peripheral surface of the second portion of the insert (such peripheral surface is at least partially surrounded by the aforementioned space) toward the common axis of the two valves.

The diameter of the first portion of the insert can exceed the diameter of the second portion. The casing can be provided with one or more channels which connect the chamber with the aforementioned space, and the first portion of the insert is disposed between the channel or channels and the space of the housing. The casing can be provided with an internal surface which is adjacent the space, and the channel or channels of the casing can extend from the internal surface to the chamber for fluid which is being drawn into the housing when the displacement body performs suction strokes. The fluid flows through the outlet valve and to one or more consumers when the displacement body performs pressure strokes.

The novel features which are considered as characteristic of the invention are set forth in particular in the appended claims. The improved pump itself, however, both as to its construction and the mode of assembling and operating the same, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
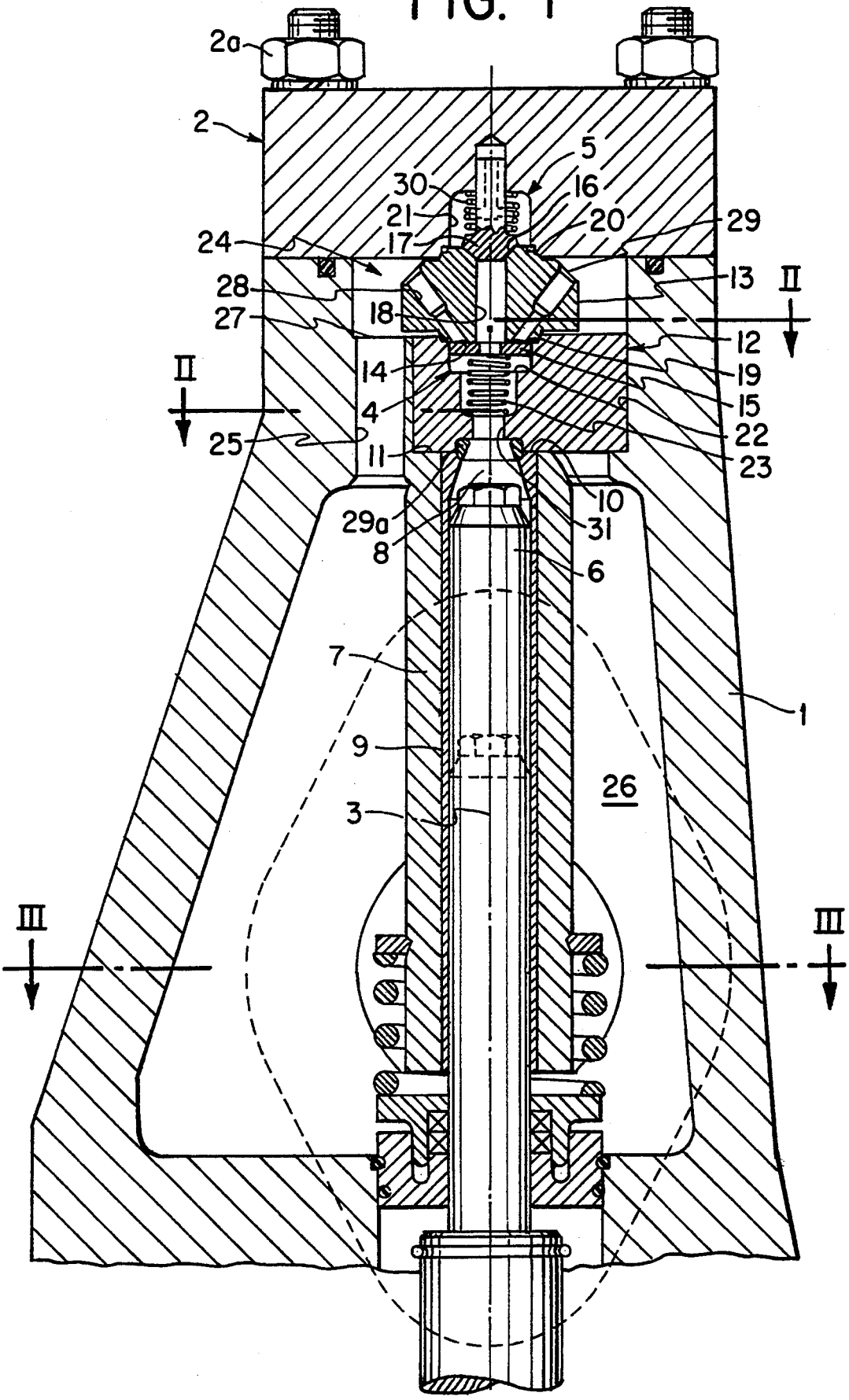
FIG. 1 is an axial sectional view of one unit of a positive displacement pump which employs three displacement bodies in the form of reciprocable plungers and embodies one form of the present invention.

The positive displacement pump which is shown in the drawings has a housing for three displacement bodies in the form of reciprocable plungers 6. The housing comprises a first part or casing 1 and a one-piece plate-like second part or head 2 affixed to the adjacent upper portion of the casing 1 by bolts and nuts **2*a* or by other suitable fasteners. FIG. 1 shows the details of one unit of the improved pump, namely the unit including one of the three plungers 6, an elongated cylinder 7 which reciprocably receives the plunger, a fluid admitting suction intake valve 4 and a fluid discharging outlet valve 5. The common axis of the valves 4 and 5 coincides with the axis 3 of the plunger 6. The cylinder 7 can be said to be floatingly mounted on the plunger 6, and its upper end face 11 (as seen in FIG. 1) abuts the adjacent side of the first or larger portion 12 of a two-piece insert installed in the casing 1 adjacent the head 2. The smaller second portion 13 of the insert is disposed between the first portion 12 and the head 2. The cylinder 7 has an axial cylindrical bore 8 for a bearing sleeve 9. The length of the bearing sleeve 9 equals or approximates the length of the cylinder 7, and the plunger 6 is reciprocably received in the sleeve. The exact construction of the means (indicated in the lower part of FIG. 1) for reciprocating the plunger 6**, so that the latter performs alternating suction and compression strokes, forms no part of the present invention.

The end face 10 of the bearing sleeve 9 is adjacent the the end face 11 of the cylinder 7 and also abuts the lower first portion 12 of the insert. The second portion 13 of the insert has a first seat 14 disposed at one end of an axially extending channel 18 and forming part of the intake valve 4, and a second seat 16 disposed at the other axial end of the channel 18 and forming part of the outlet valve 5. The intake valve 4 further comprises a plate-like valving element 15 which is biased against the seat 14 by a coil spring 23 or another suitable biasing device. The spring 23 and the valving element 15 of the intake valve 4 are confined in a recess 22 of the lower portion 12 of the two-part insert. The outlet valve 5 has a valving element 17 which is biased against the seat 16 by a coil spring 30. The spring 30 and the valving element 17 are confined in a recess 21 of the one-piece head 2 The seats 14, 16 are concentric with the channel 18 and are respectively provided on projections 19 and 20 at the respective (lower and upper) sides of the second portion 13 of the insert.

The diameter of the portion 13 is smaller than that of the portion 12, and the portion 13 is at least partially surrounded by a space 24 which is provided in the casing 1 adjacent the plane where the upper side of the casing (as viewed in FIG. 1) is in sealing engagement with the underside of the head 2. The development of the space 24 is attributable to the difference between the diameters of the portions 12, 13 and this space surrounds a peripheral surface 29 of the portion 13 The latter is provided with the aforementioned axial passage or channel 18 as well as with several suction ports 28 which are inclined relative to the channel 18 and extend from the peripheral surface 29 to the seat 14, i.e., toward the axis 3 of the plunger 6. The space 24 further communicates with a main suction chamber 26 which is defined by the casing 1 and surrounds the cylinder 7 for the plunger 6. The means for establishing communication between the chamber 26 and the space 24 includes one or more axially parallel suction channels 25 extending upwardly from the chamber 26 and terminating at an internal surface 27 of the casing 1 at the lower axial end of the space 24. The peripheral surface 29 of the portion 13 is adjacent the head 2.

In order to prevent or to reduce the likelihood of leakage of fluid between the cylinder 7 and the adjacent portion 12 of the two-part insert in the casing 1, the pumping unit which is shown in FIG. 1 further comprises a sealing sleeve **29*a* which is installed in the respective end portion of the bearing sleeve 9 and is partially recessed into the portion 12. Any pressurized fluid which happens to leak between the abutting surfaces of the portions 12 and 13 enters the space 24 and can flow into the main suction chamber 26 through the channel or channels 25**.

FIG. 1 further shows that the head 2 of the pump housing is a relatively thin one-piece plate. Thus, the thickness of this head (as measured in the direction of the common axis 3 of the valves 4, 5 and plunger 6) approximates or only slightly exceeds the axial length of the valving element 17 forming part of the outlet valve 5. When the valving element 17 is lifted off its seat 16 on the smaller-diameter portion 13 of the insert, pressurized fluid is free to flow from the channel 18 into the recess 21 and thence to one or more consumers, not shown, in a manner not forming part of the present invention. The portion 12 has an axial passage 31.

An important advantage of the improved pump is that the head 2 is not subjected to stresses or pressures which fluctuate within a wide range. Furthermore, and as already mentioned hereinbefore, any fluid which happens to leak between the portions 12 and 13 of the insert cannot escape from the pump housing but merely enters the space 24 for admission into the chamber 26 via channel or channels 25.

The seat 16 for the valving element 17 of the outlet valve 5 is located at or at least close to the plane of sealing engagement between the underside of the head 2 and the adjacent side of the casing 1.

The thickness of the head 2 can be reduced well below that of a composite head in a conventional positive displacement pump because the head 2 merely receives certain parts of the outlet valve 5 and must merely define the recess 21 which conveys pressurized fluid to one or more consumers. This renders it possible to reduce the thickness of the one-piece head 2 to such an extent that the thickness does not appreciably exceed the axial length of the valving element 17 in the recess 21.

The possibility of employing a relatively thin one-piece head 2 brings about additional advantages including savings in material, shorter finishing times, shorter assembly times, a reduction of the bulk of the pump and a corresponding reduction of weight.

The parts which are subjected to pressures that fluctuate within a rather wide range includes the two portions 12, 13 of the insert and the cylinder 7. Therefore, these parts are preferably circular or cylindrical. Such configuration of the parts 12, 13 and 7 renders it possible to complete their machining in available machinery, at a low cost and with a high degree of precision.

Figure 2:
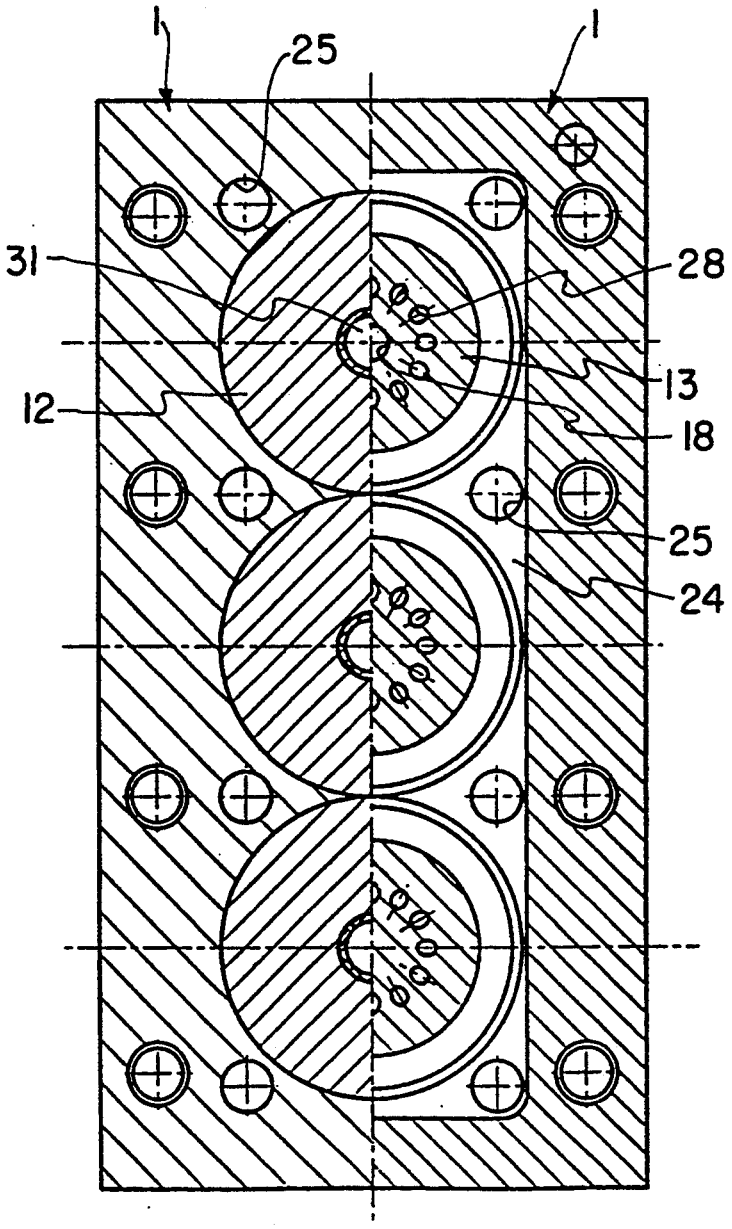
FIG. 2 is a sectional view substantially as seen in the direction of arrows from the line II—II in FIG. 1.
Figure 3:
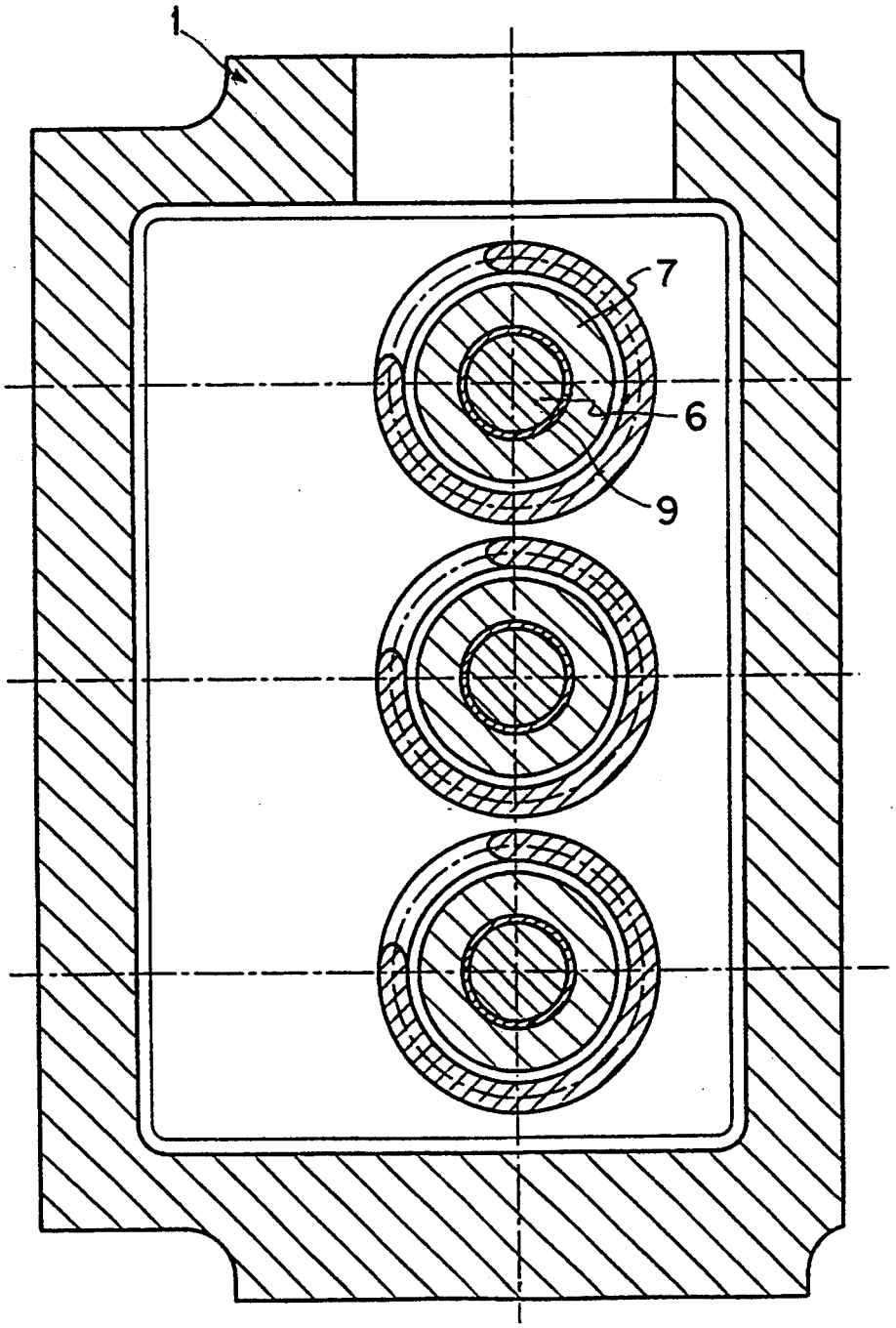
FIG. 3 is a sectional view substantially as seen in the direction of arrows from the line III—III in FIG. 1.

The improved pump can be put to use in various industries, particularly in combination with machines or plants which must receive a highly pressurized fluid, e.g., in the range of up to and in excess of 2000 bar. Machines for use in connection with hydrodynamic cleaning of concrete surfaces and the like constitute one example of systems which can receive pressurized fluid from a pump of the type shown in FIG. 1. The other two units of the composite positive displacement pump which is shown in FIGS. 1 to 3 are or can be identical with the unit shown in FIG. 1.

The mode of operation of the improved pump is analogous to that of the positive displacement pump which is disclosed in U.S. Pat. No. 5,147,189. The disclosure of this patent is incorporated herein by reference.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A positive displacement pump comprising a housing including a casing and a one-piece head affixed to said casing; an insert installed in said casing adjacent said head and including a first portion and a second portion, said second portion being disposed between said first portion and said head, said first portion being spaced from said head; a fluid admitting suction intake valve including a first mobile valving element being disposed directly adjacent to said first portion and a first seat for said first valving element being disposed at said second portion; a fluid discharging outlet valve coaxial with said intake valve and including a second mobile valving element being disposed directly adjacent to said head and a second seat for said second valving element being disposed at said second portion; and a displacement body movable in said casing to draw a fluid into a chamber of said housing, through said intake valve and to expel the fluid through said outlet valve, said first valving element includes a plate and said intake valve further comprises means for biasing said plate against said first seat, said first portion having a recess for said plate and for said biasing means, a cylinder reciprocably receiving and displacement body, abutting said first portion and disposed in said casing at least partially within said chamber.

2. A positive displacement pump comprising a housing including a casing and a one-piece head affixed to said casing; an insert installed in said casing adjacent said head and including a first portion and a second portion, said second portion being disposed between said first portion and said head, said first portion being spaced from said head; a fluid admitting suction intake valve including a first mobile valving element being disposed directly adjacent to said first portion and a first seat for said first valving element being disposed at said second portion; a fluid discharging outlet valve coaxial with said intake valve and including a second mobile valving element being disposed directly adjacent to said head and a second seat for said second valving element being disposed at said second portion; and a displacement body movable in said casing to draw a fluid into a chamber of said housing, through said intake valve and to expel the fluid through said outlet valve, said head is a one-piece plate having a predetermined thickness as measured in the direction of the common axis of said valves, said second valving element having a length, as measured in the direction of said axis, which is less than or equal to said predetermined thickness.

3. A positive displacement pump comprising a housing including a casing and a one-piece head affixed to said casing; an insert installed in said casing adjacent said head and including a first portion and a second portion, said second portion being disposed between said first portion and said head, said first portion being spaced from said head; a fluid admitting suction intake valve including a first mobile valving element being disposed directly adjacent to said first portion and a first seat for said first valving element being disposed at said second portion; a fluid discharging outlet valve coaxial with said intake valve and including a second mobile valving element being disposed directly adjacent to said head and a second seat for said second valving element being disposed at said second portion; and a displacement body movable in said casing to draw a fluid into a chamber of said housing, through said intake valve and to expel the fluid through said outlet valve, said second valving element has a predetermined length, as measured in the direction of the common axis of said valves, said head having a thickness, as measured in the direction of said axis, which is substantially greater than or equal to said predetermined length.

4. The pump of claim 3, wherein said thickness slightly exceeds said predetermined length.

5. A positive displacement pump comprising a housing including a casing and a one-piece head affixed to said casing; an insert installed in said casing adjacent said head and including a first portion and a second portion, said second portion being disposed between said first portion and said head, said first portion being spaced from said head; a fluid admitting suction intake valve including a first mobile valving element being disposed directly adjacent to said first portion and a first seat for said first valving element being disposed at said second portion; a fluid discharging outlet valve coaxial with said intake valve and including a second mobile valving element being disposed directly adjacent to said head and a second seat for said second valving element being disposed at said second portion; and a displacement body movable in said casing to draw a fluid into a chamber of said housing, through said intake valve and to expel the fluid through said outlet valve, said first portion of said insert has a first diameter and said second portion of said insert has a second diameter smaller than said first diameter, said casing has a space at least partially surrounding said second portion and said casing has at least one channel connecting said space within said chamber, said first portion being disposed between said space and said chamber.

6. The pump of claim 5, wherein said casing has an internal surface at said space and said at least one channel extends from said internal surface to said chamber.

7. A positive displacement pump comprising a housing including a casing and a one-piece head affixed to said casing; an insert installed in said casing adjacent said head and including a first portion and a second portion, said second portion being disposed between said first portion and said head, said first portion being spaced from said head; a fluid admitting suction intake valve including a first mobile valving element being disposed directly adjacent to said first portion and a first seat for said first valving element being disposed at said second portion; a fluid discharging outlet valve coaxial with said intake valve and including a second mobile valving element being disposed directly adjacent to said head and a second seat for said second valving element being disposed at said second portion; and a displacement body movable in said casing to draw a fluid into a chamber of said housing, through said intake valve and to expel the fluid through said outlet valve, said second portion has at least one suction port extending from said first seat to a space provided in said housing, said space at least partly surrounding said second portion.

8. The pump of claim 7, wherein said at least one suction port is inclined with reference to the common axis of said valves.

9. The pump of claim 8, wherein said second portion has a peripheral surface which is at least partially surrounded by said space, said at least one suction port extending from said peripheral surface toward said axis.

10. A positive displacement pump comprising a housing including a casing and a one-piece head affixed to said casing; an insert installed in said casing adjacent said head and including a first portion and a second portion, said second portion being disposed between said first portion and said head, said first portion being spaced from said head; a fluid admitting suction intake valve including a first mobile valving element being disposed directly adjacent to said first portion and a first seat for said first valving element being disposed at said second portion; a fluid discharging outlet valve coaxial with said intake valve and including a second mobile valving element being disposed directly adjacent to said head and a second seat for said second valving element being disposed at said second portion; and a displacement body movable in said casing to draw a fluid into a chamber of said housing, through said intake valve and to expel the fluid through said outlet valve, a cylinder for said displacement body, said cylinder being disposed in said casing and abutting said first portion of said insert, said displacement body being coaxial with said valves, and said cylinder being at least partially surrounded by said chamber.

11. The pump of claim 10, wherein said casing and said head have abutting substantially coplanar surfaces and said second seat is located substantially along the common plane of said surfaces.

12. The pump of claim 10, wherein said head is a one-piece plate.

13. The pump of claim 10, wherein said first valving element includes a plate and said intake valve further comprises means for biasing said plate against said first seat, said first portion having a recess for said plate and for said biasing means.

14. The pump of claim 10, wherein said first portion of said insert has a first diameter and said second portion of said insert has a second diameter smaller than said first diameter.

15. The pump of claim 10, wherein said second portion has an axially extending channel having a first end and a second end, said first and second seats being disposed at the respective ends of said channel.

16. The pump of claim 15, wherein said seats are concentric with each other and with said channel.

17. The pump of claim 15, wherein said second portion has first and second projections and said first and second seats are provided on the respective projections.

18. The pump of claim 17, wherein said first portion has a first recess for said first projection and said head has a second recess for said second projection.

* * * * *